US005927374A

United States Patent [19]

Hunter et al.

[11] Patent Number: 5,927,374

[45] Date of Patent: Jul. 27, 1999

[54] MANUFACTURING SAND MOLD CASTINGS

[75] Inventors: William A. Hunter; William G. Hunter, both of Schaumburg, Ill.

[73] Assignee: Hunter Automated Machinery Corporation, Schaumburg, Ill.

[21] Appl. No.: 09/249,504

[22] Filed: Feb. 12, 1999

Related U.S. Application Data

[62] Division of application No. 08/783,647, Jan. 15, 1997.

[51] Int. Cl.[6] ..... B22D 47/02

[52] U.S. Cl. ..... 164/130; 164/137

[58] Field of Search ..... 164/130, 137

[56] References Cited

U.S. PATENT DOCUMENTS

| | | | |
|---|---|---|---|
| 671,137 | 4/1901 | Johnston . | |
| 783,200 | 2/1905 | Henderson . | |
| 2,956,319 | 10/1960 | Deakins et al. | 164/324 |
| 3,029,482 | 4/1962 | Burnett . | |
| 3,068,537 | 12/1962 | Fellows | 164/324 X |
| 3,083,421 | 4/1963 | Taccone | 164/324 X |
| 3,123,871 | 3/1964 | Taccone | 164/323 X |
| 3,576,246 | 4/1971 | Hulet et al. | 198/19 |
| 3,605,869 | 9/1971 | Chapman et al. | 164/324 |
| 3,612,159 | 10/1971 | Galinsky | 164/324 |
| 3,682,236 | 8/1972 | Becke | 164/324 |
| 3,743,004 | 7/1973 | Becke | 164/18 |
| 3,821,978 | 7/1974 | Kauffman | 164/323 X |
| 3,955,613 | 5/1976 | Lund | 164/130 |
| 3,989,094 | 11/1976 | Gorenflo et al. | 164/324 |
| 4,040,525 | 8/1977 | Tokunaga et al. | 214/6 P |
| 4,105,060 | 8/1978 | Hauke | 164/130 |
| 4,224,979 | 9/1980 | Rosin et al. | 164/130 |
| 4,299,269 | 11/1981 | Friesen et al. | 164/324 |
| 4,422,495 | 12/1983 | Van Nette, III | 164/324 |
| 4,438,801 | 3/1984 | Buhler | 164/130 |
| 4,585,049 | 4/1986 | Sitta et al. | 164/324 |
| 4,589,467 | 5/1986 | Hunter | 164/326 |
| 4,747,444 | 5/1988 | Wasem et al. | 164/457 |
| 4,995,769 | 2/1991 | Berger et al. | 414/403 |
| 5,022,512 | 6/1991 | Hunter | 198/718 |
| 5,062,465 | 11/1991 | Mortensen | 164/4.1 |
| 5,063,987 | 11/1991 | Weimann | 164/324 |

FOREIGN PATENT DOCUMENTS

| | | | |
|---|---|---|---|
| 1236140 | 3/1967 | Germany | 164/324 |
| 3121268 | 12/1982 | Germany | 164/324 |
| 59-24570 | 2/1984 | Japan | 164/324 |
| 737113 | 5/1980 | Russian Federation | 164/324 |
| 869963 | 10/1981 | Russian Federation | 164/324 |
| 1731430 | 5/1992 | U.S.S.R. | 164/324 |
| 632104 | 11/1949 | United Kingdom | 164/324 |

*Primary Examiner*—J. Reed Batten, Jr.
*Attorney, Agent, or Firm*—Leydig, Voit & Mayer, Ltd.

[57] ABSTRACT

The upper level of a pouring conveyor receives sand molds and conveys the empty molds to a pouring station wherein molten material is deposited therein to form castings. Each mold is provided with a supportive weight and jacket before pouring. After the castings have been poured, the molds are transferred to the lower level of the pouring conveyor for cooling purposes, and then back to the upper level to remove the weight and jacket. The sand molds are then transferred to the upper level of a cooling conveyor and are deposited into trays provided on the cooling conveyor. Each tray is adapted to receive a plurality of molds to enable the molds to move from serial to parallel movement. An indexable pusher arm is provided to accurately place each mold in a respective tray to insure proper spacing for uniform cooling. After each tray has traversed the upper and lower levels of the cooling conveyor, the molds are removed from the trays and the sand is broken away to reveal the castings for harvest. The volumetric capacity and cooling time can be adjusted simply by adjusting the number of trays disposed on the cooling conveyor.

5 Claims, 6 Drawing Sheets

MANUFACTURING SAND MOLD CASTINGS

This is a divisional of copending application Ser. No. 08/783,647, filed on Jan. 15, 1997, pending.

FIELD OF THE INVENTION

The present invention generally relates to mold handling systems, and more particularly relates to sand mold handling systems.

BACKGROUND OF THE INVENTION

Molded metal castings are commonly manufactured at foundries through a matchplate molding technique which employs green sand molds comprised of prepared sand and additives which are compressed around cope and drag patterns mounted on opposite sides of a matchplate. The sand mold is thus formed in upper and lower matching portions, an upper cope mold, and a lower drag mold. The cope mold is formed in a separate cope flask which is filled with prepared sand and compacted onto the matchplate. The matchplate is then removed leaving an indentation in the cope mold of the desired shape for the upper portion of the casting. Simultaneously, the drag mold is formed in a separate drag flask. Usually the matchplate is in the form of a planar member with the pattern for the cope mold on one side and the pattern for the drag mold on the other. After the cope and drag molds have been formed, they are placed together to form a unitary mold having an interior cavity of the desired shape. The cavity can then be filled with molten metal through an inlet or "sprue" provided in the cope mold to create the desired casting. Such a system is disclosed in Hunter U.S. Pat. No. 5,022,212.

As with many volume sensitive production operations, manufacturers are required to automate the manufacturing process in order to remain competitive. Foundries engaging in the casting of metal objects through the use of green sand molds are not immune to this reality. It is common in today's marketplace, for the machine which produces the sand molds to be connected to a machine which fills the sand mold with molten metal, which in turn is connected to a machine for cooling the molten metal into a solid casting, which in turn is connected to a machine for removing the sand mold and revealing the casting for harvest. Such a system is disclosed in Hunter U.S. Pat. No. 4,589,467.

In the aforementioned '467 patent, the sand molds are manufactured and communicated along a linear conveyor to a circular, rotating, or "carousel" conveyor. Molten metal is introduced into the molds at one location on the carousel and the molten metal is then allowed to cool within the sand mold as the carousel rotates. The carousel is provided with both an outer diameter track and an inner diameter track which provide for additional cooling of the metal, and which increase the throughput of the machine.

While such a carousel system has enjoyed, and continues to enjoy, considerable commercial success, it is not without its drawbacks. In particular, if a manufacturer wishes to increase the throughput of a carousel-type molding machine, a carousel of a different diameter will necessarily have to be employed, at considerable additional expense. In addition, every time a new carousel is needed, a substantial downtime period is encountered wherein the machine is not producing castings, and which requires considerable labor to put into effect.

Similarly, if the cooling times of the metal being processed through machine are variable, the length of the cooling cycle will accordingly be affected. With a carousel-type conveyor, the cooling cycle time can be increased either by slowing the carousel, or by adding a carousel of a greater diameter. Conversely, if the cooling time is to be lessened, the rotational speed of the carousel can be increased, or a carousel having a smaller diameter can be added. However, both options are less than desirable. If the carousel is slowed, the throughput of the machine is proportionally diminished, and if a new carousel is added, additional expense is incurred due to increased downtime and additional equipment overhead.

SUMMARY OF THE INVENTION

It is the primary aim of the present invention to provide a sand mold handling system with improved cooling or dwell time adjustability and capability.

It is an objective of the present invention to provide a sand mold handling system with improved volumetric capacity or throughput capability.

It is another objective of the present invention to provide a sand mold handling system with more uniform cooling in order to provide more physically reliable and predictable castings.

In these regards, it is a feature of the present invention to provide a sand mold handling system having a separate pouring conveyor, and a separate cooling conveyor.

It is another feature of the present invention to provide a mold handling system wherein both the pouring conveyor and the cooling conveyor are provided with upper and lower decks to increase the cooling cycle and throughput capabilities of the system.

It is still another feature of the present invention to provide a double-deck cooling conveyor with a plurality of elongated trays disposed thereon, with each tray being capable of receiving more than one sand mold. Therefore, the sand molds move through the double-deck pouring conveyor in serial fashion, and are transferred to the cooling conveyor trays in batches, to thereby result in transformation from serial to parallel movement. This necessarily results in a longer cooling cycle, and increased throughput capability.

It is a still further feature of the present invention to provide a modular cooling conveyor with a volumetric capacity which is adjustable simply by adding or subtracting the number of operating modules, or trays, disposed thereon.

It is a still further feature of the present invention to provide a cooling conveyor having trays as described above wherein the respective positions of each sand mold in each tray are accurately and consistently controlled to thereby provide for uniform air gaps between the molds and thus a more uniform cooling process.

These and other objectives and features of the invention will become more apparent from the following detailed description when taken in conjunction with the accompanying drawings.

Figure 1:
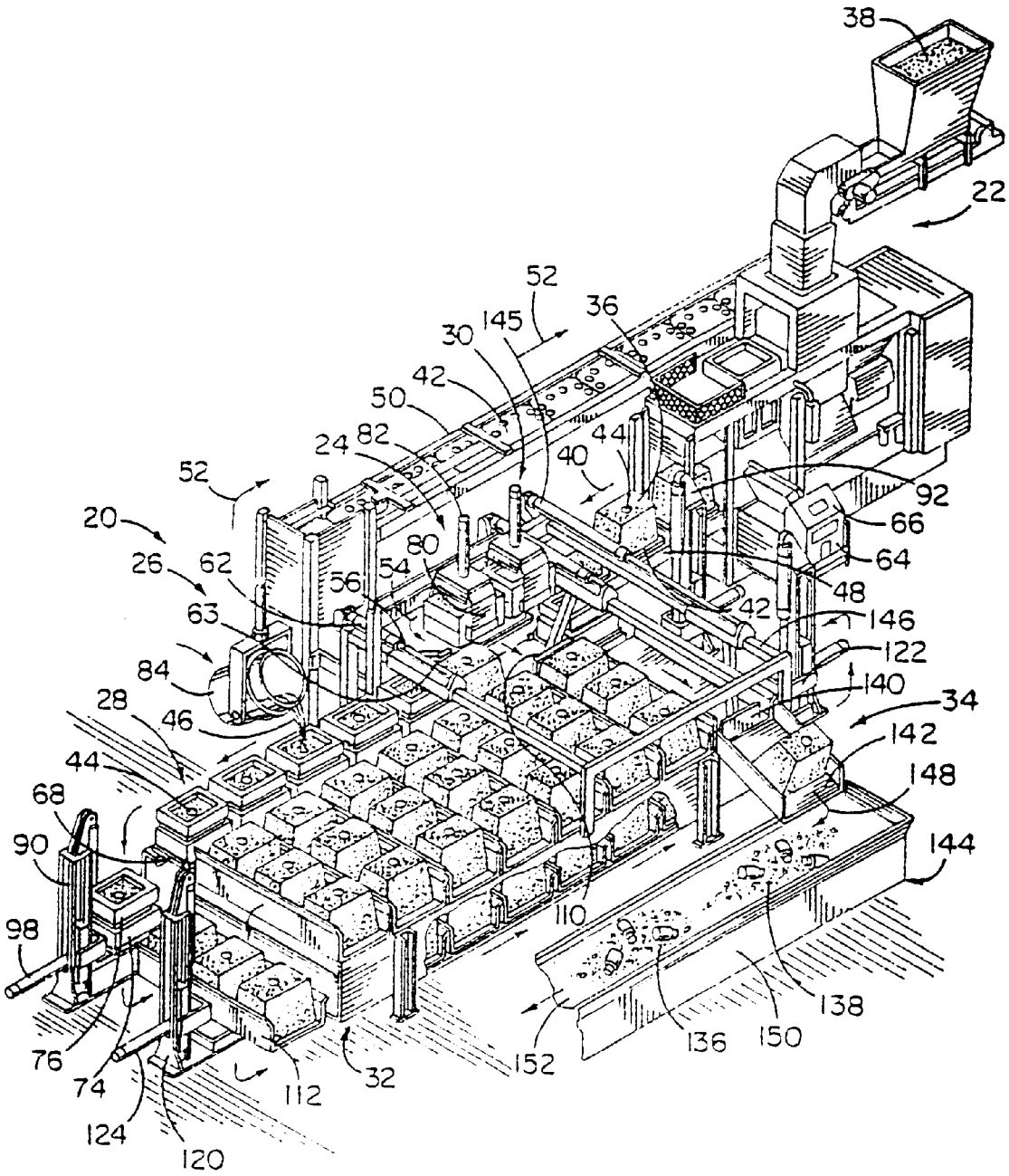
FIG. 1 is a perspective view of the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to FIG. 1, the present invention, generally depicted as sand mold handling system 20 is comprised of sand mold forming station 22, weight and jacket installation station 24, pouring station 26, pouring conveyor 28, weight and jack removal station 30, cooling conveyor 32, and discharge station 34. As depicted by the directional arrows shown in FIG. 1, the motion of sand mold 36 from start to finish, defines a linear flow path, the importance of which will be discussed in further detail.

Although the present invention is directed toward the mold handling system, for completeness and clarity of function the machine depicted in FIG. 1 also shows a sand mold forming station 22 which produces sand molds 36. It is to be understood that sand mold forming station 22 is of a conventional matchplate forming design in which sand 38 is compressed within a flask about a matchplate. The sand mold is typically formed from two portions (not shown), an upper cope mold, and a lower drag mold. One cope mold and one drag mold are combined to form a unitary sand mold 36 comprised of compressed sand and having an internal cavity of the desired shape for the casting. Those of ordinary skill in the art will understand that cores can be inserted into the cavity so as to form internal apertures within the resulting castings. Such cores are also typically formed from compressed sand. Such a process is described in the aforementioned Hunter U.S. Pat. No. 5,022,512, the disclosure of which is expressly incorporated by reference herein.

As shown in FIG. 1, sand molds 36 exit from sand mold forming station 22 in the direction depicted by arrow 40. Sand molds 36 exit station 22 on transport platforms 42, and are provided with inlets, or sprues, 44 for the entrance of molten metal 46. First conveying mechanism 48 is provided to transport sand molds 36 from sand mold forming station 22 to weight and jacket installation station 24. A second conveying mechanism 50 is provided to transport platform 42 back to sand mold forming station 22 in the direction depicted by arrows 52 after molds 36 are moved to weight and jacket installation station 24.

Figure 3A:
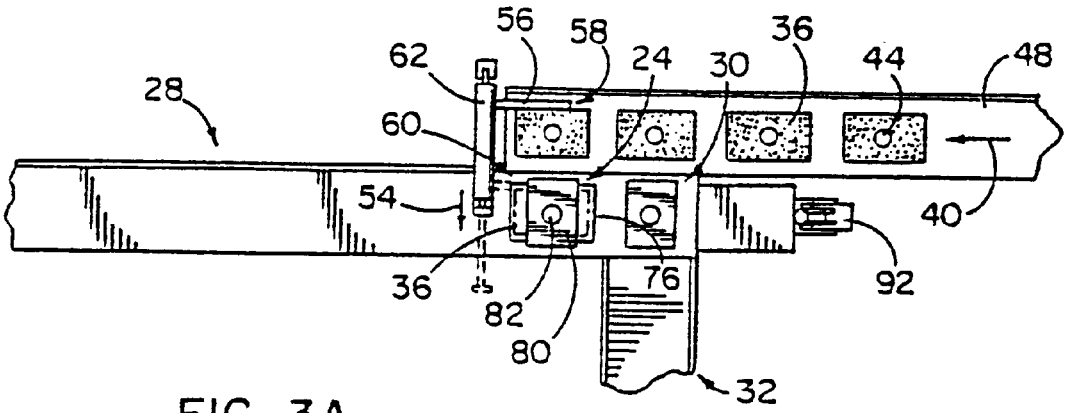
FIG. 3A is a schematic view of the transfer of sand molds onto the pouring conveyor.

Upon reaching the end of first conveying mechanism 48, sand molds 36 are moved from first conveying mechanism 48 to weight and jacket installation station 24 in the direction depicted by arrow 54. Weight and jacket installation station 24 is located along upper track 86 of pouring conveyor 28. As shown in FIG. 3A, this motion is accomplished through the use of pusher arm 56 which is indexable between position 58 and position 60 shown in shadow in FIG. 3A. Pusher arm 56 is powered by pneumatic or hydraulic ram 62 which is of a simple and conventional design. Pusher arm 56 includes substantially rectangular flap 63 which engages sand molds 36.

Figure 2:
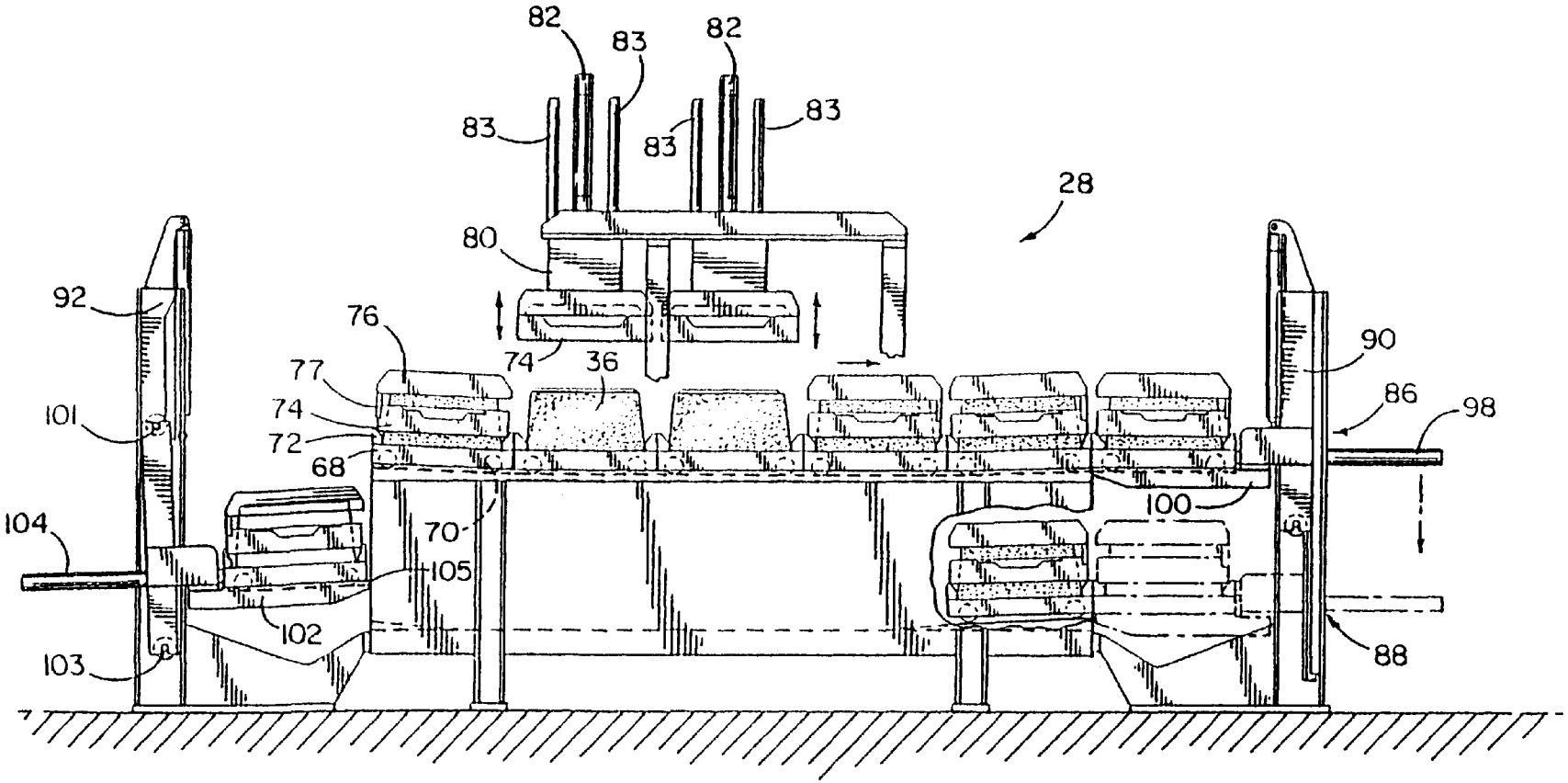
FIG. 2 is a side view of the pouring conveyor.

Sand molds 36 are moved from platforms 42 to baseplates 68 at weight and jacket installation station 24. As best shown in FIG. 2, baseplates 68 are provided with casters 70 to provide locomotion to sand molds 36, and raised comers to provide support to the comers of sand mold 36 and align the jacket 74 therewith as will be described with further detail herein. After being placed on baseplate 68, jacket 74 is installed around the middle of sand mold 36, and weight 76 is placed on top of sand mold 36. In the preferred embodiment, weights 76 include spacers 77 to separate weights 76 from jackets 74. The sides of sand mold 36 are slanted to facilitate this installation.

Figure 3B:
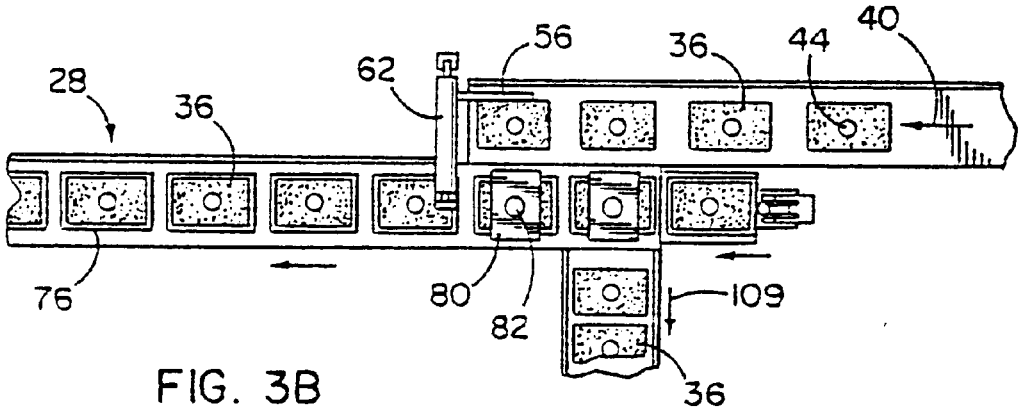
FIG. 3B is a schematic view showing sand molds being inserted to and removed from the pouring conveyor.
Figure 3C:
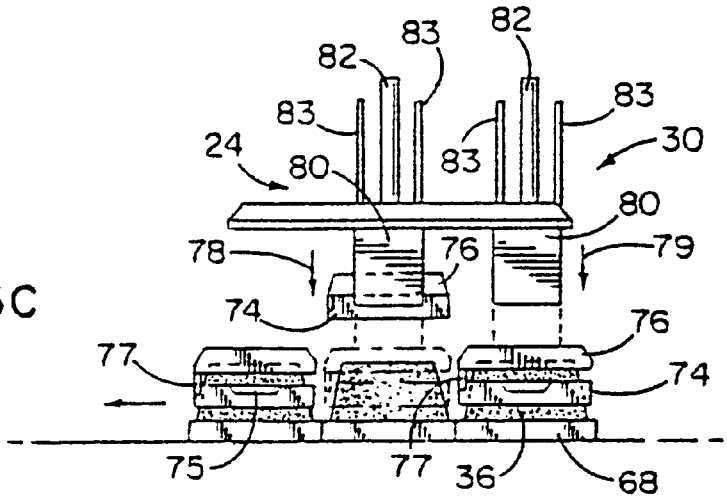
FIG. 3C is a side view of the weights and jackets being installed onto one sand mold and removed from another sand mold.

The installation of jacket 74 and weight 76 are best depicted in FIG. 3C wherein the motion of jacket 74 and weight 76 as they are being placed onto sand molds 36 is depicted by arrow 78. Gripper arms 80 are provided to grasp and release jacket 74 and weight 76 through frictional, magnetic, or other methods. Gripper arms 80 are adapted to move up and down along main shaft 82, and auxiliary rods 83 as best shown in FIG. 2. In the preferred embodiment, gripper arms 80 are provided with hooks which engage ledges 75 (FIGS. 3C–3E) provided on jackets 74.

From weight and jacket installation station 24, sand molds 36, equipped with jacket 74 and weight 76, proceed to pouring station 26 along upper track 86 of pouring conveyor 28. As depicted in FIG. 1, it is at pouring station 26, that molten metal 46 is introduced into sand molds 36 through sprue 44. In the embodiment depicted in FIG. 1, molten metal 46 is introduced into sand molds 36 from vat 84, although other mechanisms for such action are certainly possible. In the preferred embodiment, vat 84 is mounted on an overhead track (not shown) which allows vat 84 to be manually transported from a source of molten metal to pouring station 26. It is to be understood that although pouring station 26 is shown in a specific location, pouring station 26 may be moved to a number of positions along pouring conveyor 28.

Referring now to FIG. 2, pouring conveyor 28 is shown in detail. It is pouring conveyor 28 which transports sand molds 36 from weight and jacket installation station 24 to pouring station 26 and ultimately to weight and jacket removal station 30 in a continuous loop. Pouring conveyor 28 is comprised of upper track 86 and lower track 88 wherein communication between upper track 86 and lower track 88 is accomplished by elevator 90 and communication between lower track 88 and upper track 86 is accomplished through elevator 92. It is important to note that pouring conveyor 28 is not a "conveyor" in the traditional sense in that it does not include any internal driving mechanism, but rather is comprised of rails along which baseplates 68 having casters 70 are pushed via rams 98 and 104 provided on elevators 90 and 92, respectively.

As shown in FIG. 2, each baseplate 68 is in engagement with other baseplates 68 situated both fore and aft. Elevators 90 and 92 not only provide motion between upper track 86 and lower track 88, and vice versa, but also provide locomotion along upper track 86 and lower track 88 through the use of rams 98. As shown in FIG. 2, after elevator 90 moves sand mold 36 from upper track 86 to a position adjacent lower track 88 (shown in dashed lines), ram 98 pushes sand mold 36 from pallet 100 to lower track 88. The force of this motion directs sand mold 36 onto lower track 88, and by engaging the other sand molds 38 on lower track 88, pushes the other sand molds 36, and ultimately pushes one sand mold 36 onto pallet 102 of the second elevator 92. Elevator 92 then lifts sand mold 36 to upper track 86, and through the use of ram 104 pushes sand mold 36 onto upper track 86. Therefore, it can be seen that pouring conveyor 28 is comprised of a multiple, yet discrete number of positions and sand molds 36 are indexed serially from one position to the next. As best shown by elevator 92 shown in FIG. 2, the elevators of the present invention are adapted to tilt backward to allow sufficient clearance during each lift. Upper pivot 101 and lower pivot 103 cooperate to tilt pallet 102 so that front lip 105 of pallet 102 is raised to a height sufficient to clear upper track 86 and lower track 88. This arrangement substantially eliminates the possibility of baseplate 68 not being raised to a sufficient height and thereby engaging the end of each track and preventing movement of the baseplate from the pallet and to the upper and lower tracks.

Figure 3D:
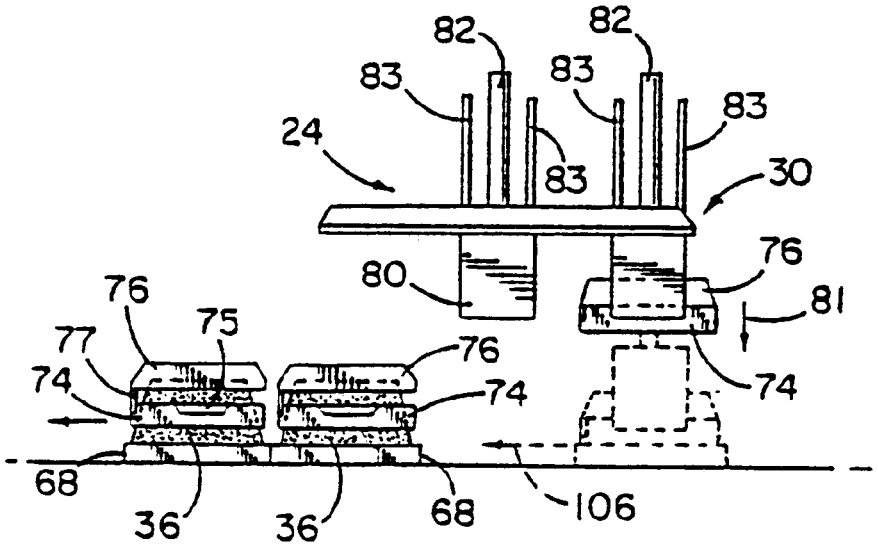
FIG. 3D is a side view of a weight and jacket set being separately transported by the pouring conveyor to be installed onto another sand mold.
Figure 3E:
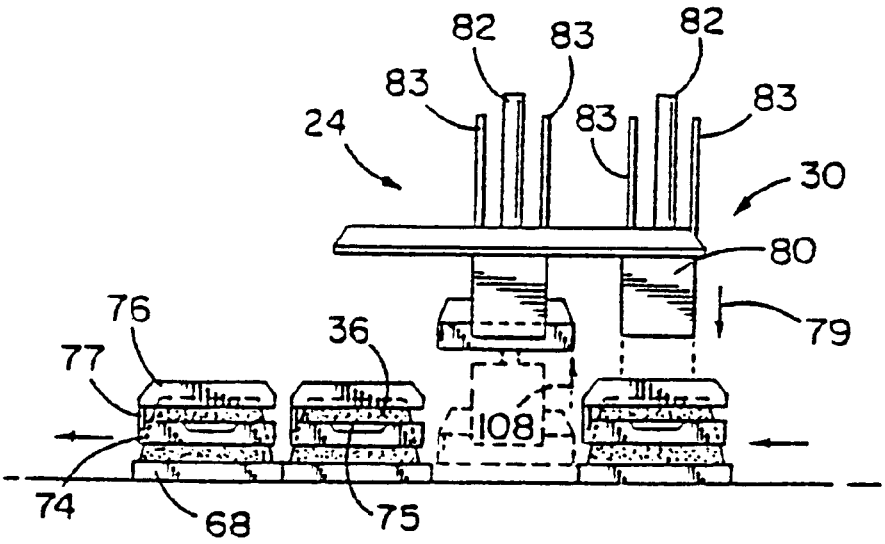
FIG. 3E is a side view of a weights and jacket set being removed from one sand mold and an unused set being picked up for insertion onto another sand mold (not shown).

It is to be understood that as molten metal 46 is introduced into sand molds 36 at pouring station 26 molten metal 46 immediately begins to cool. As sand molds 36 traverse pouring conveyor 28, molten metal 46 continually cools to a semi-solid state. Therefore, upon reaching weight and jacket removal station 30, weights 76 and jackets 74 can be removed as depicted in FIG. 3C without molten metal 46 affecting the integrity of sand mold 36. The removed jacket 74 and weight 76 are then placed back on base plate 68 and indexed to weight and jacket installation station 24 in the direction depicted by arrows 106. As alluded to earlier, raised comers 72 of baseplates 68 are used to align jackets 74 on top of baseplates 68. At weight and jacket installation station 24, gripper arms 80 again grasp jacket 74 and weight 76 and lift them upward along shaft 82 as best shown in FIG. 3E by directional arrow 108. After jacket 74 and weight 76 have been lifted at weight and jacket installation station 24 to the position shown in FIG. 3E, a newly formed sand mold 36 is pushed onto upper track 86 by pusher arm 56 as discussed earlier and as depicted in FIG. 3A.

As shown in FIG. 3C, at weight and jacket removal station 30, gripper arms 80 move downward in the direction of arrow 79 to grip the weights and jackets and then upward to lift the weights and jackets off sand mold 36. Sand mold 36 is then moved to cooling conveyor 32 in the direction of arrow 109 shown in FIG. 3B, and the weight and jacket set just removed is placed back down onto baseplate 68 as shown in FIG. 3D in the direction of arrow 81.

Figure 4:
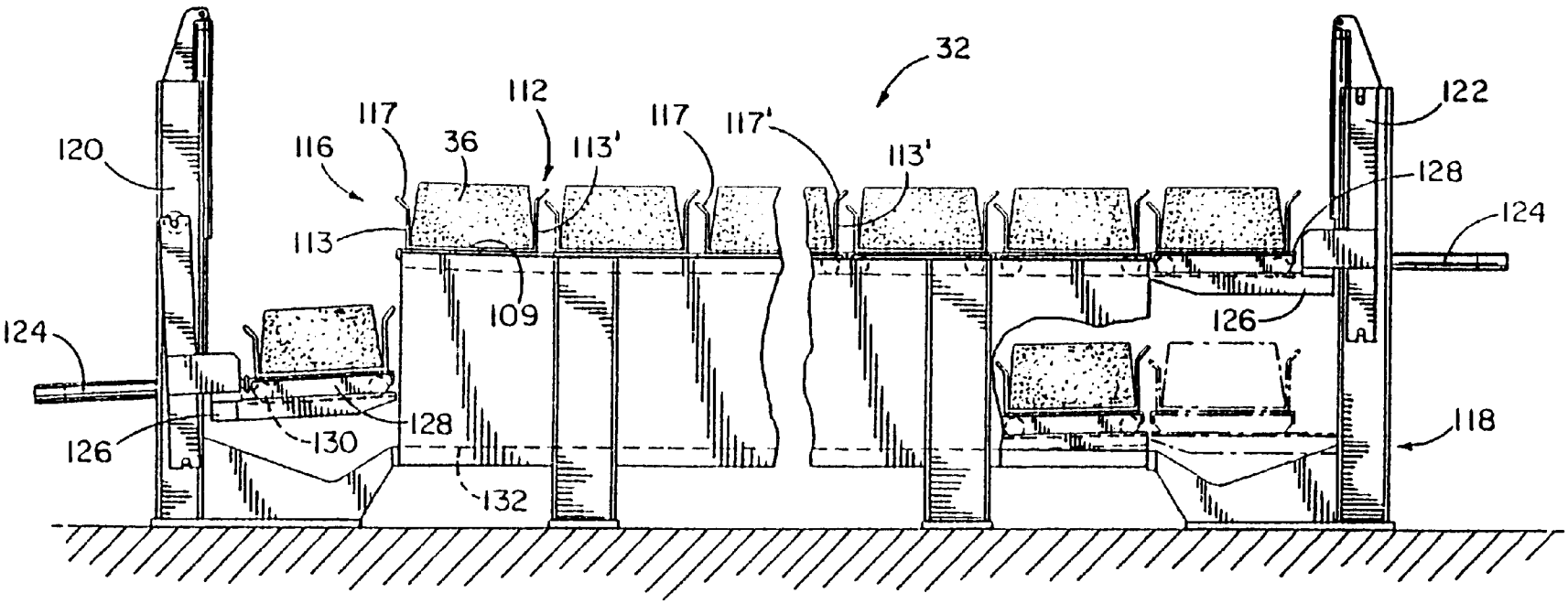
FIG. 4 is a side view of the cooling conveyor.
Figure 5:
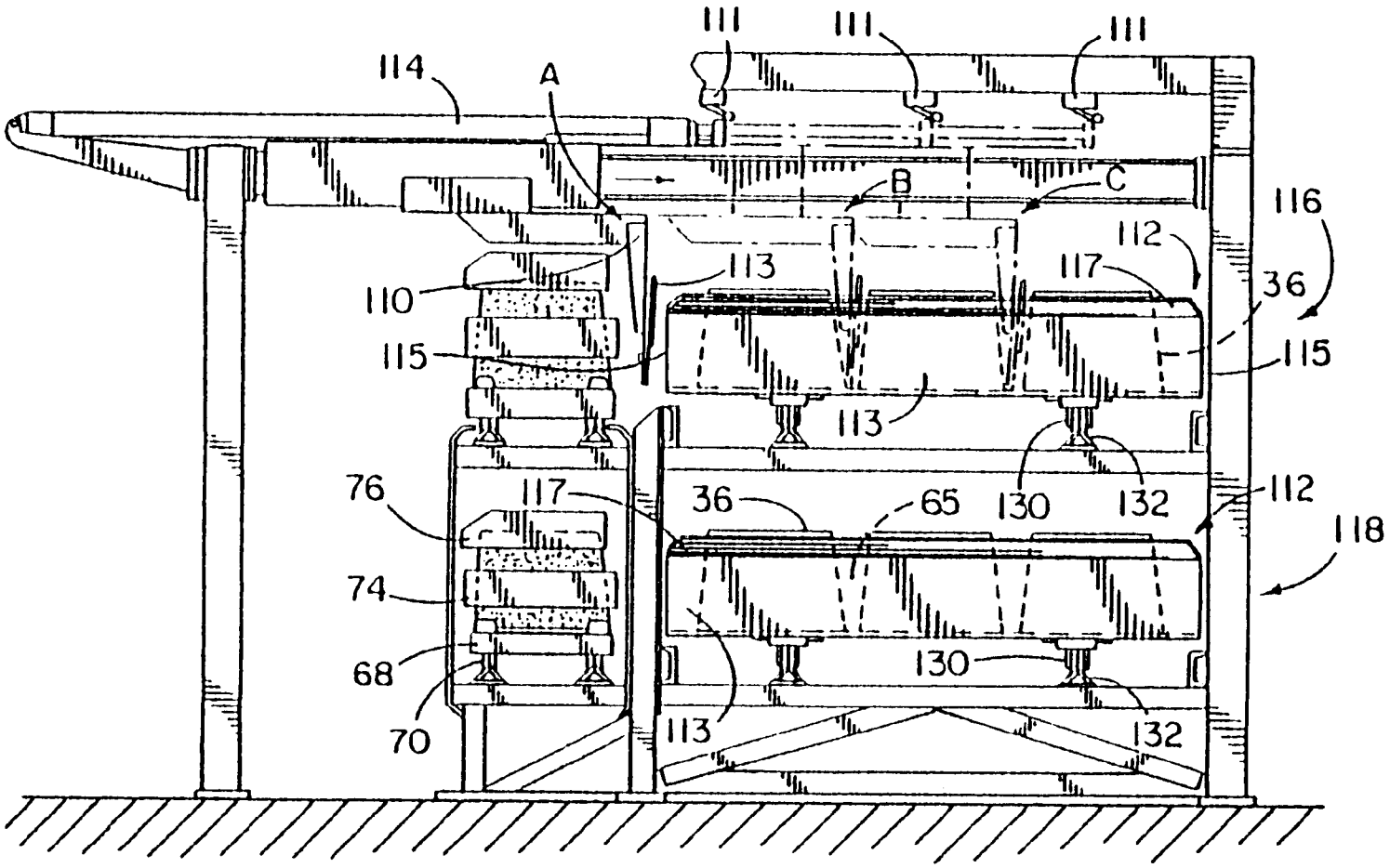
FIG. 5 is an end view of the pouring and cooling conveyors showing the upper and lower conveyors and the multiple indexable positions of the pusher arm for placement of the sand molds on the cooling trays.

Turning now to FIGS. 4 and 5, cooling conveyor 32 is shown in detail. After jackets 74 and weights 76 have been removed from sand molds 36, pusher arm 110 pushes sand molds 36 into tray 112. Pusher arm 110 is similar to pusher arm 56 in that it is powered by a hydraulic ram, in this case, ram 114, and includes flap 113 for engagement with sand molds 36.

As best shown in FIG. 5, tray 112 is adapted to receive three sand molds 36 in the preferred embodiment, although trays which are capable of accommodating fewer or more sand molds 36 are certainly possible. Pusher arm 110 is therefore capable of indexing to any one of three positions A, B, and C as shown in FIG. 5, and as controlled by proximity switches 111. When arm 110 reaches a proximity switch 111, a signal is sent to ram 114 to stop movement of ram 110. This positions sand mold 36 appropriately and allows arm 110 to be retracted to be in position to move another sand mold 36. By accurately controlling the positioning of sand molds 36, the air gaps 65 around sand molds 36 are more precisely controlled, the cooling of molten metal 46 is therefore more uniform, and the resulting castings 136 are more mechanically sound. Moreover, by adjusting the number of sand molds 36 placed on each tray 112, the volume of processed molds can be altered.

After a given tray 112 is filled to capacity, each tray 112 is indexed ahead, and a new tray 112 is provided in line with pusher arm 110 to receive additional sand molds 36 from pouring conveyor 28. Although trays 112 of various shapes can be employed, in the preferred embodiment of the present invention, trays 112 include bottom 109, two opposed sides 113 and 113', and two open ends 115. Side 113 includes angled top edge 117 while side 113' includes angled top edge 117' to hinder the progression of sand falling from sand molds 46 into the working elements of secondary cooling station 32. Side 113' is provided at a greater height than side 113 so that angled edge 117' engages side 113 at the nexus between side 113 and edge 117. Therefore, when trays 112 engage one another to index along cooling conveyor 32, the sides 113 and 113' act like bumpers, and edges 117 and 117' overlap to prevent sand from falling downward.

Similar to the construction of pouring conveyor 28, cooling conveyor 32 is provided with upper track 116, lower track 118, elevator 120 for communicating trays 112 from upper track 116 to lower track 118, and elevator 122 for communicating trays from lower track 118 back up to upper track 116. Also similar to primary cooling station 22, the source of locomotion for trays 112 along upper track 116 and lower track 118 is provided through rams 124 which push trays 112 from pallets 126 onto tracks 116 and 118.

As best depicted in FIG. 4, each tray 112 is provided on a cart 128 with casters 130 adapted to roll along rails 132 (FIG. 5). Also shown in FIG. 5, the lower surface of each tray 112 is provided at a level equal to the level of each baseplate 68. Therefore, when sand castings 36 are moved from pouring conveyor 28 to cooling conveyor 32, the sand molds 36 need not be lifted up or down, but can simply be moved horizontally across by pusher arm 110.

As will be apparent to those of ordinary skill in the art, cooling conveyor 32 provides ample dwell time for molten metal 46 to cool within sand molds 36. By the time sand molds have traversed upper track 116 and lower track 118, and have been lifted back to upper track 116, molten metal 46 has hardened into casting 136. Therefore, sand residue 138 can be removed from castings 136 at discharge station 34 (FIG. 1). In the preferred embodiment, this is accomplished through the use of pusher arm 140 in conjunction with ramp 142 and breakdown bin 144. Breakdown bin 144 is provided with a vibrating conveyor to facilitate separation of residue 138 from castings 136.

As best shown in FIG. 1, pusher arm 140 is adapted for hydraulic movement via ram 145 along beam 146 to remove sand molds 36 from trays 112. Upon reaching ramp 142 sand molds 36 fall to breakdown bin 144 through the effects of gravity as depicted by arrow 148. The force of this downward movement causes sand molds 36 to contact side walls 150 of breakdown bin 144, which in turn causes residue 138 to fall away from castings 136. Vibrating removal conveyor 152 is provided to facilitate removal of sand residue 138, and separate mechanisms are provided for recycling sand residue 138, and for removing castings 136 for harvest.

In operation, the present invention provides a mold handling system wherein the travel of the individual sand molds 36 is substantially linear to more easily allow for an adjustable throughput volume and a more variable cooling cycle as opposed to carousel systems, wherein potential volume is limited by the diameter of the carousel, and which can only be adjusted by replacing the carousel with another unit of a different diameter. In contrast, the throughput of the present invention can be more easily adjusted simply by moving elevator 120 outward, extending the length of cooling conveyor 32 and adding additional trays 112. In the preferred embodiment, the present invention involves the use of eight trays 112, but as is shown in FIG. 1, larger systems are certainly possible.

Another significant advantage of the present invention is the simplified handling of weights 76 and jackets 74, as well as the very limited number of weights and jackets actually needed to operate the entire system. As best shown in FIG. 1, weights 76 and jackets 74 are removed from sand molds 36 before the molds are transferred to cooling conveyor 32. The weights and jackets therefore are only used at pouring conveyor 28, which therefore limits the number of weights and jackets required for the whole system. This necessarily reduces the cost of the mold handling system 20.

In addition, since the present invention is numerically controlled via control 64, and is capable of dynamic modification through operator input module 66, the dwell time or cooling time of the metal within each sand mold 36 is also adjustable. The speed with which sand molds 36 are generated from sand mold forming station 22 is adjustable, as is the speed of primary cooling station 28 and secondary cooling station 32. Since each of these functions is centrally controlled as are the movements of pusher arms 56, 110, and 140, the parameters of the entire system 20 can be uniformly increased and decreased.

From the foregoing, it will be appreciated that the present invention brings to the art a new and improved sand mold handling system wherein the volume of molds capable of being processed, and the cooling time of the sand molds are more adjustable. When it is desired to increase the volume or cooling time, the length of the cooling conveyor can be increased and additional trays can simply be added to the secondary cooling conveyor. Similarly, when it is desired for the volume or cooling time to be decreased, the number of trays can be reduced, or the number of sand molds placed on each tray can be reduced. By controlling the length of trays and accurately indexing the sand molds into the appropriate positions within each tray, the cooling of the castings is more uniform, and thus the yield of the overall system is more reliable.

What is claimed is:

1. A method of manufacturing sand mold castings, comprising the steps of:

forming sand molds of compressed sand having a mold cavity therein;

placing the sand molds on a pouring conveyor;

filling the sand molds with molten material after the sand molds have been placed on pouring conveyor, the sand molds progressing along the pouring conveyor in serial fashion;

transferring the sand molds to a cooling conveyor having a variable number of trays disposed thereon, the trays adapted to receive a plurality of sand molds, the trays moving along the cooling conveyor with a plurality of sand molds therein to thereby result in a transition from serial to parallel movement of the sand molds, the molten material in the sand molds cooling during progression along the cooling conveyor; and removing the sand molds from the conveyor trays such that the sand breaks away from the castings formed therein to enable the castings to be harvested.

2. The method of claim 1, further including the step of placing supportive weights and jackets onto each sand mold prior to filling the sand molds with molten material.

3. The method of claim 1, wherein the placing step is performed through a pusher arm which pushes the sand molds onto the pouring conveyor.

4. The method of claim 1, wherein the transferring step is performed by a pusher arm which pushes the sand molds from the pouring conveyor to the trays of the cooling conveyor.

5. The method of claim 1, wherein the removing step is performed by a pusher arm which pushes the sand molds out of the cooling conveyor trays.

* * * * *